US006860298B2

(12) United States Patent
Kontani

(10) Patent No.: US 6,860,298 B2
(45) Date of Patent: Mar. 1, 2005

(54) HOST COMPUTER FOR USE IN LOOM USER SUPPORTING SYSTEM, LOOM USER SUPPORTING SYSTEM, LOOM USER SUPPORTING METHOD

(75) Inventor: Hideyuki Kontani, Tsubata-machi (JP)

(73) Assignee: Tsudakoma Kogyo Kabushiki Kaisha, Kanazawa (JP)

( * ) Notice: Subject to any disclaimer, the term of this patent is extended or adjusted under 35 U.S.C. 154(b) by 251 days.

(21) Appl. No.: 10/234,475

(22) Filed: Sep. 5, 2002

(65) Prior Publication Data

US 2003/0098086 A1 May 29, 2003

(30) Foreign Application Priority Data

Sep. 26, 2001 (JP) ..... 2001-294732

(51) Int. Cl.[7] ..... G06F 19/00

(52) U.S. Cl. ..... 139/1 R; 139/1 C; 139/62; 377/15; 377/16; 340/825.17; 700/140

(58) Field of Search ..... 377/15, 16; 66/75.2, 66/232; 139/62, 1 C, 11, 1 R; 340/825.17; 700/140

(56) References Cited

U.S. PATENT DOCUMENTS 3,570,550 A * 3/1971 Budzyna ..... 139/336
4,736,324 A * 4/1988 Sainen et al. ..... 700/140
4,835,699 A * 5/1989 Mallard ..... 700/140
4,893,250 A * 1/1990 Sainen ..... 700/140
4,918,613 A * 4/1990 Iwano et al. ..... 700/113
4,943,927 A * 7/1990 Yarita et al. ..... 700/140
5,016,183 A * 5/1991 Shyong ..... 700/131
5,034,897 A * 7/1991 Sainen ..... 700/140
5,060,161 A * 10/1991 Sainen ..... 700/140
5,200,904 A * 4/1993 Tottman ..... 700/131
5,246,039 A * 9/1993 Fredriksson ..... 139/452
5,261,463 A * 11/1993 Sato ..... 139/1 R
5,321,621 A * 6/1994 Sainen ..... 700/140
5,676,177 A * 10/1997 Shofner et al. ..... 139/1 C
6,130,746 A * 10/2000 Nevel et al. ..... 356/238.2
6,269,282 B1 * 7/2001 Burger et al. ..... 700/131
6,467,039 B1 * 10/2002 Fredriksson ..... 713/151
6,532,996 B2 * 3/2003 Tamura ..... 139/1 E
6,650,959 B1 * 11/2003 Bouvyn ..... 700/143
6,697,089 B1 * 2/2004 Bryan ..... 345/747
6,741,726 B1 * 5/2004 Nevel et al. ..... 382/111
6,748,290 B2 * 6/2004 Somaia ..... 700/140

FOREIGN PATENT DOCUMENTS

| | | |
|---|---|---|
| EP | 0 459 527 A | 12/1991 |
| EP | 0 518 810 A | 12/1992 |
| JP | 05-272037 A | 10/1993 |
| JP | 5-272037 A | 10/1993 |

* cited by examiner

*Primary Examiner*—John J. Calvert
*Assistant Examiner*—Robert Muromoto
(74) *Attorney, Agent, or Firm*—Smith Patent Office

(57) ABSTRACT

A host computer is used in a supporting system for supporting a user of a plurality of looms. The host computer includes a database section for storing specifications information relating to specifications of each of a plurality of looms, the specifications information including apparatus information relating to an operating apparatus provided in each loom, and an advice information providing section for receiving query information sent via a communications way, and identifying a loom based on the received query information, and creating advice information with respect to the identified loom based on specifications information extracted from the database section with respect to the loom, and providing the advice information.

20 Claims, 2 Drawing Sheets

HOST COMPUTER FOR USE IN LOOM USER SUPPORTING SYSTEM, LOOM USER SUPPORTING SYSTEM, LOOM USER SUPPORTING METHOD

BACKGROUND OF THE INVENTION

1. Field of the Invention

This invention relates to a host computer for use in a user supporting system of a number of looms to efficiently operate looms installed in a weaving factory, a loom user supporting system using such a host computer, and a loom user supporting method.

2. Description of the Related Art

Heretofore, there have been known loom user supporting systems in which user computers are connected to a host computer via a communications way, e.g., Japanese Unexamined Patent Publication No. HEI 5-272037. This publication discloses that a host computer which is loaded with an expert system advises suitable weaving conditions in response to a query from an external apparatus, e.g., a user computer, by utilizing the expert system.

In the conventional art disclosed in the above publication, the host computer does not provide advice concerning weaving conditions with respect to a specific loom which is actually installed and on service in a weaving factory, and merely provides advice concerning general weaving conditions. Accordingly, it is not always the case that the contents of the advice are applicable to a specific loom on service in the weaving factory. On the contrary, frequently is the case that adequate advice is not providable. As a matter of fact, actually installed looms in the weaving factories differ one from another in the specifications thereof. Accordingly, it would not be useful to receive an advice requesting use of an apparatus which has not actually used in the questioned loom, or an advice concerning operating conditions and setting conditions of the questioned loom on the premise that such an apparatus be loaded.

SUMMARY OF THE INVENTION

It is an object of the invention to overcome the aforementioned drawbacks residing in the prior art.

According to an aspect of the invention, a user who uses a plurality of looms is supported by providing him/her with practically feasible advice information with respect to individual looms in a weaving factory. Specifications information relating to specifications of each of a plurality of looms are stored, and an advice information is provided by receiving query information sent via a communications way, and identifying a loom based on the received query information, and creating advice information with respect to the identified loom based on specifications information extracted from the database section with respect to the loom.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
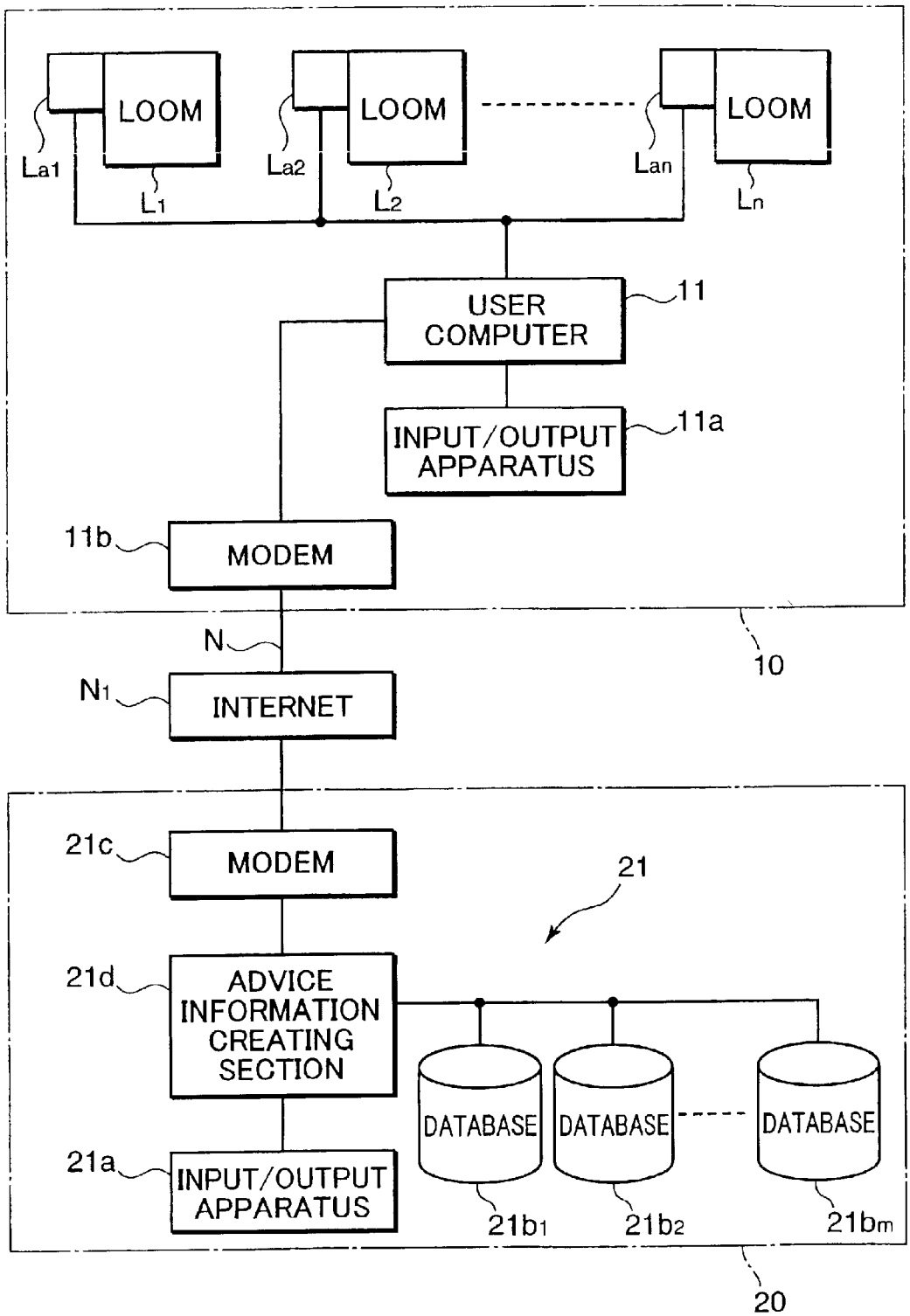
FIG. 1 is a schematic diagram exemplarily showing an overall configuration of a user supporting system according to an embodiment of the invention.

A loom user supporting system according to a preferred embodiment of the present invention is described with reference to the accompanying drawings. The loom user supporting system includes a host computer or server 21 provided in a service center 20 of a producer or manufacturer who had produced looms and a number of user computers or clients 11 installed in user's weaving factory 10 (hereinafter, simply referred to as "factory 10"). In FIG. 1 is simply shown a user computer 11 accessible to the host computer 21.

In the factory 10, a number of looms Li (i=1, 2, . . . , n) are installed, and each loom Li is provided with data transmission units Lai (i=1, 2, . . . , n) connectable to the user computer 11. The user computer 11 is equipped with an input/output apparatus 11*a* including a keyboard, a display monitor, printer, etc. The user computer 11 is connected to a communications way N including the Internet N1 via a modem 11*b*.

The host computer 21 is equipped with a number of database sections 21*bj* (j=1, 2, . . . , m) as well as input/output apparatus 21*a*. The host computer 21 is connected to the communications way N via a modem 21*c*. The host computer 21 includes an advice information creating section 21*d* for creating advice information in response to query information.

The data transmission unit Lai provided in each loom Li is on-line connected to the user computer 11. With this arrangement, the user computer 11 is operable as an administrative computer for collecting data concerning the operating status of each loom Li which is transmitted from the corresponding data transmission unit Lai to monitor the operating efficiency of the loom Li.

Figure 2:
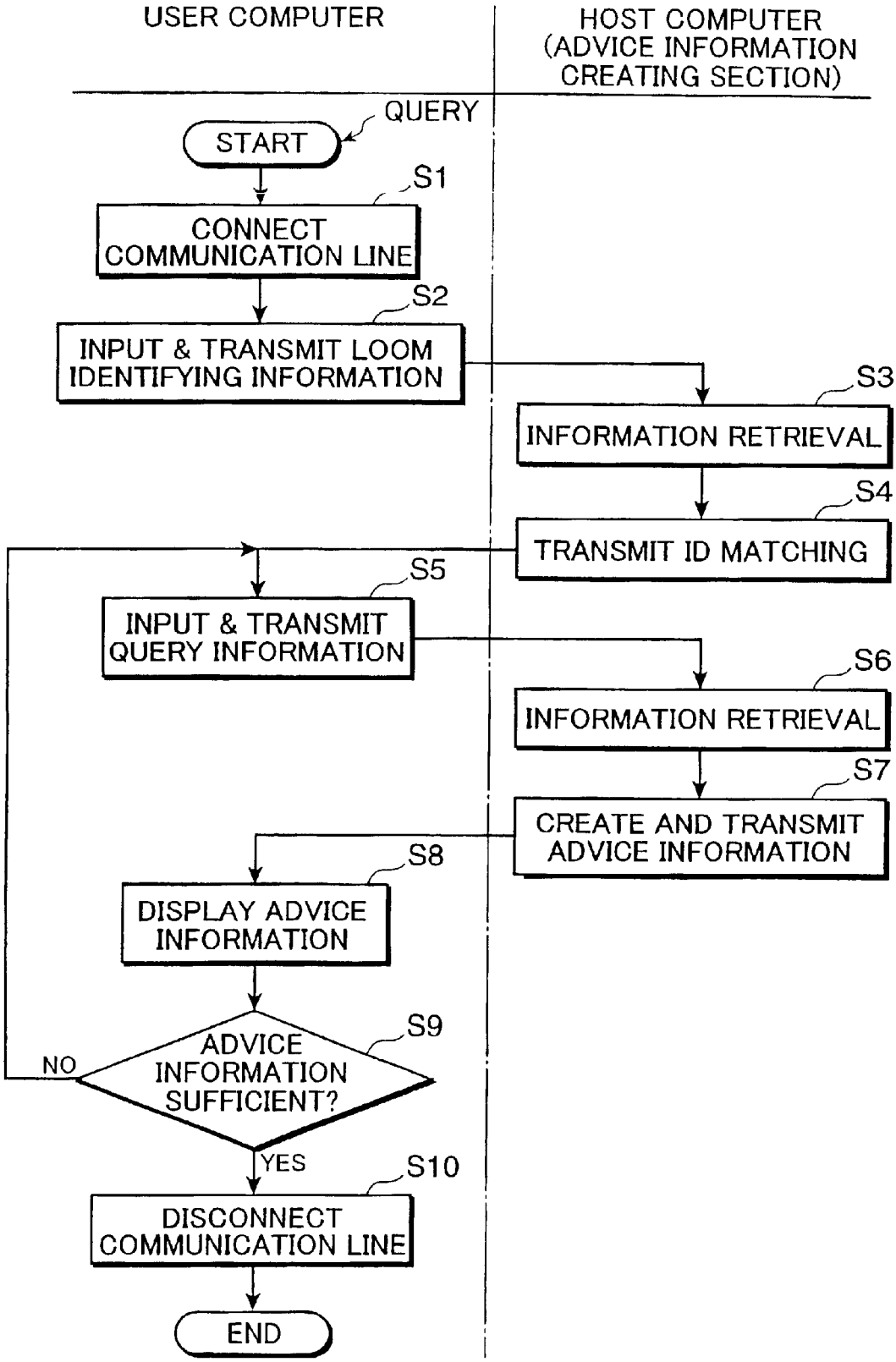
FIG. 2 is a flowchart showing a flow of operations of a user computer and a host computer in the user supporting system.

In the case where a user has a query concerning an operation of a specified loom Li, the user accesses the host computer 21 via the communications way N from the user computer 11, and transmits query information to the host computer 21 via the user computer 11 to obtain advice information from the advice information creating section 21*d*, as shown in FIG. 2.

More specifically, referring to FIG. 2, when the user implements a predetermined operation on the user computer 11 to connect the communication way N to the host computer 21, and to access the host computer 21 (Step S1), and inputs loom identifying information to identify the loom Li on which the user has a query via the input/output apparatus 11*a* (Step S2), the user computer 11 is operative to transmit loom identifying information to the advice information creating section 21*d*.

Upon receiving the loom identifying information from the user computer 11, the advice information creating section 21*d* performs retrieval operation to search for necessary data from a database section 21*bj* (Step S3). When specifications information relating to the specifications of the loom Li and apparatus information relating to operating apparatus provided in the loom Li are retrieved from the database section 21*bj*, confirmation information indicating that the specifications information and the apparatus information with respect to the questioned loom Li have been successfully retrieved is transmitted to the user computer 11 (Step S4).

Upon receiving the confirmation information, the input/output apparatus 11*a* of the user computer 11 is caused to display that the host computer 21 has identified the loom Li, and the user is authorized to input and send a query relating to the loom Li for which advice information is required to the host computer 21 (Step S5). The advice information creating section 21*d* starts retrieval operation again with respect to the database section 21*bj* (Step S6), creates advice information in reply to the query based on the specifications information relating to the requested loom Li, and automatically transmits the advice information to the user computer 11 (Step S7).

Upon receiving the advice information, the display monitor of the input/output apparatus 11*a* of the user computer 11 is caused to display the advice information sent from the host computer 21 (Step S8). If the user judges that the display contents are sufficient (YES in Step S9), the user implements a predetermined operation on the user computer 11 to disconnect the communication way N from the user computer 11 to the host computer 21 (Step S10). On the other hand, if the user judges that the display contents are insufficient (NO in Step S9), the user inputs by a key board of the input/output apparatus 11*a* and the user computer 11 sends an additional query to the advice information creating section 21*d* (Step S5) to obtain advice information in reply to the additional query (Steps S6 to S9). It should be appreciated that the user is allowed to use the printer, which is one of the input/output apparatus 11*a*, so as to print out the display contents on the display monitor of the input/output apparatus 11*a* in Step S8 on recording paper or the like when need arises to do so.

The database section 21*bj* of the host computer 21 stores the specifications information relating to each loom Li as well as the apparatus information relating to the operating apparatus provided in each loom Li. In view of this, in Steps S3 and S4 in FIG. 2, the advice information creating section 21*d* is operative to perform retrieval operation with respect to the database section 21*bj* based on the loom identifying information from the user computer 11 and to transmit the confirmation information that the specifications information relating to the requested loom Li has been retrieved to the user computer 11. The apparatus information relating to the operating apparatus provided in each loom Li is systematically and hierarchically stored in the database sections 21*bj* to identify each operating apparatus as follows:

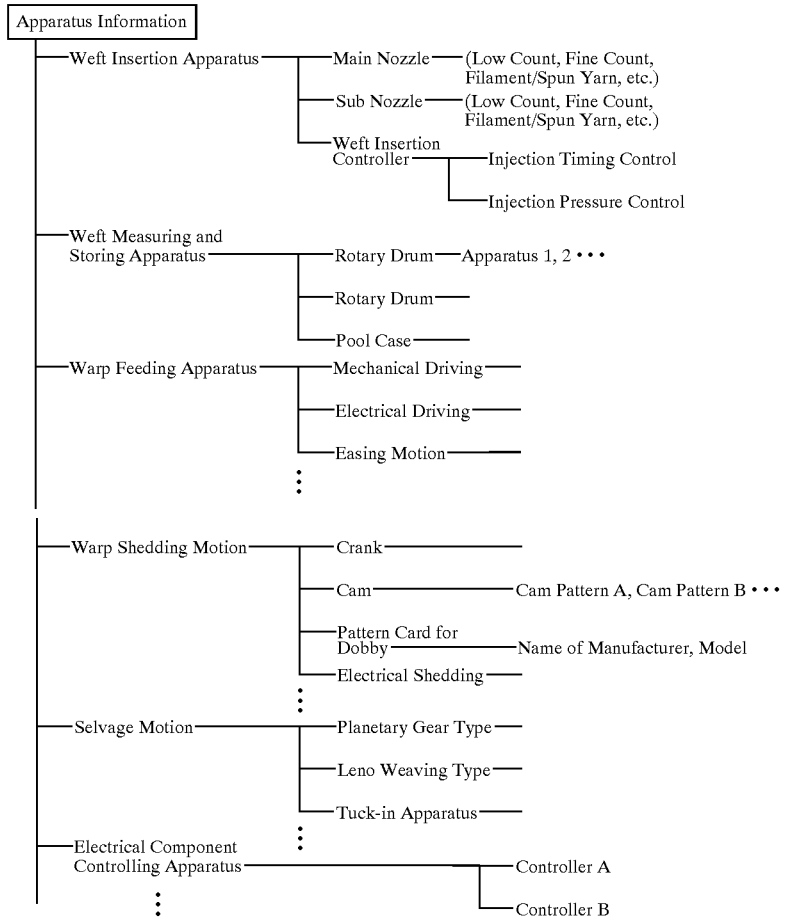

*Each apparatus information includes information inherent to the apparatus, such as model name, parts number, necessary version symbol, etc.

The following TABLES 1 and 2 show what is functionally implemented in the user supporting system with respect to query items entered by a user, query information, retrieval operations by the host computer, and advice information.

TABLE 1

| Item | Query contents entered by user | Query information | Operation to be implemented by host computer | Advice information |
|---|---|---|---|---|
| 1 | Ask for information as to whether weaving according to requested weaving specifications executable or requested loom satisfies weaving requirements | Weaving specifications<br>specifications<br>$\frac{\text{WARP} \times \text{WEFT}}{\text{WARP} \cdot \text{DENSITY} \times \text{WEFT} \cdot \text{DENSITY}} \times \text{FABRIC} \cdot \text{WIDTH}$<br>Fabric type<br>(fabric construction)<br>Requirements on loom<br>rotating number | Retrieve specifications information | Information as to whether weaving according to requested weaving specifications is executable<br>provide reference value on setting conditions if weaving is executable<br>provide necessary information to make weaving executable<br>if weaving is not executable → if order of parts to modify apparatus is necessary, provide necessary instruction on order |
| 2 | Ask for information as to method of adjusting/setting, mounting, and disassembling apparatus, parts thereof | Apparatus name (parts number, etc.)<br>Operation contents<br>adjustment, maintenance<br>in disassembling (replacement of expendable item), assembling (mounting),<br>oiling, cleaning | Retrieve maintenance information | Display operation procedures (in terms of characters, illustrations, animated images, etc.) |
| 3 | Ask for information as to check-up items of apparatus, parts thereof | Proper time for check-up (year/month, time for looming, time for replacing beam, etc.) | Retrieve maintenance information | List-up apparatus, parts for operation is needed<br>Display check-up items and operation procedures with respect to listed apparatus, parts (in terms of characters illustrations, animated images, etc.) |

TABLE 2

| Item | Query contents entered by user | Query information | Operation to be implemented by host computer | Advice information |
|---|---|---|---|---|
| 4 | Ask for information as to compatibility of apparatus, parts thereof | Number of parts available on hand | Retrieve compatibility information | Judgment as to whether parts mounted on loom have compatibility<br>display instruction information as to how to cope with incompatibility<br>ex. in case additional requirement makes loom operable of weaving, display specific instruction such as display message to suggest purchase of compatible parts |
| 5 | Ask for information as to troubleshooting<br>operation-related trouble (warp, weft, fabric defect)<br>breakdown-related trouble | Operation-related trouble<br>contents of trouble (trouble on weft lead end, etc.)<br>frequency of occurrence (times per unit time)<br>other necessary data (setting conditions, fabric specifications data)<br>Breakdown-related trouble<br>contents of trouble (in terms of trouble code)<br>frequency of occurrence | Retrieve troubleshooting information | Display check-up procedures and outlines on troubleshooting (in terms of characters, illustrations, animated images, etc.) |
| 6 | Ask for information as to updating, upgrading of apparatus, parts thereof, electrical component, software application | | Retrieve updating information | Display presence or absence of updated, upgraded apparatus, parts, and software application<br>if updated software application is available, display price, delivery date, loading method, added function, etc. of updated software application |

Details of advice information as to whether weaving according to requested weaving specifications is executable by a requested loom are as follows.

Information as to Whether Weaving is Executable

- Preparatory weaving conditions (production conditions of warp, way of passing, selection of dropper pin, etc.)
- Setting conditions on operating apparatus of loom
  - Weft insertion apparatus (kind of nozzle, mounting position, number of needles, injection pressure, timing of injection, etc.)
  - Warp shedding motion (shedding amount, frame height, timing of frame, shedding curve, etc.)
  - Warp tension control (warp tension, diameter of beam, setting on easing motion, etc.)
  - Setting on number of rows (position correction amount of cloth fall at time of suspending/starting up loom, etc.)
  - Selvage motion (judgment as to whether apparatus is of planetary gear type or leno weaving type, cross-timing, etc.)
  - Start-up method (torque of drive motor, selection of blank beating start or not, etc.)
  - •
  - •
  - •
  - •
  - •

The database section 21*bj* also stores information on maintenance, compatibility, troubleshooting, updating, etc. with respect to each operating apparatus. The information is roughly classified into two categories. Specifically, one is information which relates to the operating apparatus individually such as maintenance information and compatibility information. The other is information which has interrelationship between one operating apparatus and another operating apparatus, such as part of troubleshooting information. The information belonging to the former category can be handled as attributes of each operating apparatus. The information belonging to the latter category is handled as attributes of the loom Li depending on the loaded status of each operating apparatus.

In the case where the user makes a query as to whether weaving according to specific weaving specifications is executable by a requested loom Li (see Item No. 1 in TABLE 1), the user performs a predetermined operation on the user computer 11 to identify the loom Li and sends a query such as the specifications of a fabric, and the rotating number of the requested loom Li to the advice information creating section 21*d*. Upon receiving the query information, the advice information creating section 21*d* retrieves the specifications information with respect to each loom Li in the database section 21*bj*, and transmits advice information as to whether the requested Loom Li is capable of weaving the fabric according to the requested weaving specifications, as well as detailed contents concerning the weaving conditions as mentioned above if it is judged that the requested loom Li is capable of weaving according to the requested weaving specifications based on the specifications information of the loom Li including the apparatus information. If the requested loom Li is incapable of weaving according to the requested weaving specifications, the host computer 21 transmits advice information relating to requirements to satisfy the user's request (see TABLES 1 and 2).

In the user supporting system of the embodiment, the user can make a query on compatibility of the operating apparatus or parts thereof (see Item No. 4 in TABLE 2). Specifically, the user designates specific parts or operating apparatus of a loom Li by the key board of the input/output apparatus 11 and the user computer 12 sends a query, for example, asking the number of the specific parts or the serial number of the operating apparatus to the advice information creating section 21*d*. Then, the advice information creating section 21*d* is operative to retrieve compatibility information from the database section 21*bj* as to whether the operating apparatus or the parts is compatible, and transmits advice information as to whether the operating apparatus or the parts is compatible to the user computer 11. If it is judged that the operating apparatus or the parts is incompatible, the advice information creating section 21*d* transmits advice information to the user computer 11 that the operating apparatus or the parts is incompatible as well as countermeasures to compensate for the incompatibility. As exemplified measures, in the case where it is judged that the operating apparatus is usable or compatible by furnishing with parts or modifying the operating apparatus, the advice information creating section 21*d* transmits information relating to a specific instruction such as a method for making the operating apparatus usable or compatible. On the other hand, if it is judged that the operating apparatus is incompatible, the advice information creating section 21*d* transmits information relating to a specific instruction such as a way of purchasing compatible parts, the approximate delivery date, and the price thereof.

Further, in the similar manner as mentioned above, the advice information creating section 21*d* can transmit to the user computer 11 appropriate advice information to query information such as the method for adjusting and mounting the operating apparatus, parts thereof, etc. (see Item No. 2 in TABLE 1), items to be inspected with respect to the operating apparatus, and parts thereof (see Item No. 3 in TABLE 1), troubleshooting (see Item No. 5 in TABLE 2), and updating information concerning parts and electrical components, and software applications (see Item No. 6 in TABLE 2) with respect to each loom Li. It should be appreciated that the database sections 21*bj* of the host computer 21 store all the necessary relevant information to automatically create advice information in response to all the query information listed in TABLES 1 and 2.

Next, a modification of the embodiment is described. Elements in the modification that are identical or substantially equivalent to those in the embodiment are denoted at the same reference numeral, and the modification is described with reference to FIGS. 1 and 2. In the modification, it is possible to make a data transmission unit Lai provided in each loom Li connectable to a host computer 21 individually, thereby functioning the data transmission units Lai as user computers 11 respectively.

Further, the data transmission unit Lai each may have a function of automatically setting conditions in which the operable conditions are automatically set with respect to part or all of the operating apparatus provided in each loom Li. Specifically, upon receiving advice information which is output from the advice information creating section 21*d* in response to query information from the data transmission unit Lai, the data transmission unit Lai analyzes the advice information and automatically sets the operable conditions to each operating apparatus based on the advice information. In the case where the data transmission unit Lai provided in each loom Li is used as a user computer 11 as in the modification, the user computer 11 (see FIG. 1) may be an administrative computer, may be so configured as to be connectable to the host computer 21, or may be so configured as to be non-connectable to the host computer 21. As a further altered form, the user computer 11 in the modification may be a stand-alone type computer which is provided independently of the loom Li.

In the modification, database sections 21*bj* of the host computer 21 store specifications information relating to a plurality of looms Li including apparatus information relating to operating apparatus provided in each loom Li. Preferably, the advice information creating section 21*d* creates advice information at least as to whether weaving according to requested weaving specifications is executable by a requested loom Li so as to transmit the advice information to the user computer 11.

More specifically, in the modification, it is essentially required to allow the database section 21*bj* of the host computer 21 to store specifications information with respect to each loom Li including apparatus information loaded on each loom Li. Preferably, the advice information creating section 21*d* may create advice information in response to a query as to whether weaving according to a requested weaving specifications is executable, and send the advice information to the user computer 11 (see Item No. 1 in TABLE 1). Further, as regards the Item Nos. 2 through 6 in TABLES 1 and 2, it may be preferable to store at least one of the maintenance information, compatibility information, troubleshooting information, and updating information in the database section 21*bj*. Further, the function of creating advice information (see Item Nos. 2 through 6 in TABLES 1 and 2) in response to the above information can be omitted according to needs.

In the case where a plurality of looms Li identical to one another in the arrangement or specifications are installed in the factory 10, and all the information relating to the looms Li are stored in the database section 21*bj* as attributes of the looms Li, a large part of the contents of the above-mentioned information which are stored in the database section 21*bj* may be overlapped with the result that the storage capacity required for the database section 21*bj* may be exceedingly large. In view of this, it is preferable to classify the apparatus information relating to the operating apparatus loaded on each loom Li into loom-related information which should be handled as attributes of the looms Li and apparatus-related information which should be handled as attributes of each operating apparatus in a database section 21*bj* for storage therein and to share the latter information or the apparatus-related information among the looms Li. Generally, the host computer 21 is accessible from a plurality of user computers 11. Accordingly, the system is configured in such a manner that the loom-related information are stored in a database section 21*bj* as individual information for each user, and that each user is authorized to access the host computer 21 exclusively with respect to the looms Li installed in the user's factory 10.

Furthermore, the specifications information with respect to each loom Li stored in the database sections 21*bj* may be revisable and renewable in the service center 20 when need arises to do so. Such revising and updating may be executed upon receiving information from the user that a new apparatus or new parts is provided or replaced on the loom Li. Alternatively, the system may be configured in such a manner that the user can desirably revise or update the specifications information in the database section 21*bj* relating to each loom Li installed in the factory 10 on the user's own discretion.

In the case where data revising or updating is performed with respect to the database sections 21*bj*, the system may be configured in such a manner that the host computer 21 is operative to store the history of each database section 21*bj*, and to provide the history to the user computer 11 upon request therefrom. According to the modification, the host computer 21 can provide the user computer 11 advice information relating to the approximate delivery date, the price of the operating apparatus, parts thereof, as well as information relating to the seller or manufacturer of such apparatus or parts thereof for contact. Also, the host computer 21 has a function of accepting order information relating to an apparatus or parts thereof from the user computer 11.

As described above, a novel host computer is used in a supporting system for supporting users of a plurality of looms. The host computer comprises a database section for storing specifications information relating to specifications of each loom, and an advice information providing section for providing advice information in response to query information. The specifications information includes apparatus information relating to operating apparatus provided in each loom. The host computer is operative to identify a loom based on query information sent from an external apparatus via a communications way to create advice information with respect to the identified loom based on the specifications information extracted from the database section with respect to each loom, and to send the advice information to the external apparatus.

Also, a novel method for supporting a user using a plurality of looms, comprises the steps of: storing specifications information relating to specifications of each of a plurality of looms, the specifications information including apparatus information relating to an operating apparatus provided in each loom; receiving query information sent via a communications way; identifying a loom based on the received query information; creating advice information with respect to the identified loom based on the stored specifications information with respect to the loom; and providing the advice information.

The advice information may include a judgment as to whether weaving according to requested weaving specifications is executable by the requested loom in response to the query information.

The database section may store apparatus identifying information with respect to each operating apparatus to identify each operating apparatus. Also, the database section may store apparatus information including at least one of maintenance information, compatibility information, troubleshooting information, and updating information with respect to each operating apparatus.

The database section stores the specifications information including the apparatus information relating to each of the operating apparatus provided in each loom. Upon receiving query information from an external apparatus, the host computer is operative to retrieve necessary data from the database section to identify the loom based on loom identifying information attached to the query information. The host computer is operative to automatically create advice information in response to the query information with respect to the identified or requested loom based on the specifications information extracted from the database section with respect to the loom, and to send the advice information to the external apparatus.

The advice information includes information relating to the loom which has been identified by the loom identifying information attached to the query information, which is practically applicable to the identified loom. It should be appreciated that the operating apparatus are those actually provided in each loom, such as a weft insertion apparatus, a weft measuring and storing apparatus, a warp feeding apparatus, a warp shedding motion, a selvage motion, an electrical component controlling apparatus, etc.

The loom identifying information may include information relating to the type, serial number, lot number, and delivery date of the loom, as well as information that is sufficient to specify the user of the loom such as the user name, the name of the weaving factory, and the layout information of the loom in the weaving factory.

It will be seen that the novel host computer has the following advantageous effects. The specifications information including the apparatus information relating to each of the operating apparatus provided in each loom is stored in the database section. Advice information with respect to a loom identified or requested by externally sent query information can be created and sent to the query sender based on the specifications information with respect to the loom. The advice information is proper to the actual specifications of the identified loom, and is applicable for the identified loom. Accordingly, this is remarkably useful for the user, and the looms installed in a weaving factory can be operated more efficiently.

An answer as to whether weaving according to the requested weaving specifications is executable by the requested loom as advice information enables the host computer to provide appropriate information as to whether the requested loom can weave a fabric according to the requested weaving specifications.

The contents of the information relating to the weaving specifications which is inquired from the external apparatus may include the kind of warp and weft, the density thereof, the width of the fabric, the construction of the fabric, and the desired number of rotation of the loom. Further, in the case where it is judged that weaving according to the requested weaving specifications is executable, the advice information from the host computer may include a series of requirements on weaving such as: production conditions of the warp and weft; preparatory weaving conditions such as the way of passing, and selection of dropper pin; setting conditions relating to the weft insertion apparatus such as the kind of weft insertion nozzle, the mounting position thereof, the number of needles, the fluid injection pressure, and the timing of injection; setting conditions relating to the warp shedding motion such as the shedding amount, the height of frame, the timing of frame, and the shedding curve; conditions relating to warp tension control such as the tension of the warp, the diameter of the beam, and setting on the easing motion; setting conditions relating to the number of rows such as the position correction amount of a cloth fell at the time of suspending/starting up operation of the loom; setting conditions relating to the selvage motion such as discrimination as to whether the selvage motion is of a planetary gear type or a leno weaving type, and cross-timing of the selvage motion; setting conditions relating to the start-up method of the loom such as the torque of the drive motor and selection of the blank beating start or not.

The host computer is operative to store, in the database section, apparatus identifying information with respect to each operating apparatus, namely, the model name, serial number, parts number, necessary version number thereof, etc. as specifications information with respect to each loom, and to identify each operating apparatus provided in each loom. The information relating to maintenance, compatibility, troubleshooting, and updating of each operating apparatus are stored in the database section in association with the apparatus identifying information. With this arrangement, the host computer is operative to retrieve necessary data from the database section with respect to the requested loom and to send the necessary data to the external apparatus as advice information.

The maintenance information may include operation procedures such as method of adjusting and setting an apparatus on which maintenance is requested, method of mounting a requested apparatus, and method of disassembling an apparatus, discrimination as to whether regular inspection and/or maintenance is necessary, and contents of inspection and/or the maintenance in terms of characters, illustrations such as still images and/or animated images, vocal sounds, etc.

The compatibility information may include discrimination as to whether a preparatory apparatus or parts thereof which is designated by the user and is available on the user side has compatibility. In case that the preparatory apparatus or parts thereof is incompatible, the contents and method of a required working or modification, ordering method of a compatible apparatus or parts, the price thereof, etc. may be included in the compatibility information.

The troubleshooting information may include contents on operation-related trouble such as trouble concerning warp and weft, and a fabric defect, and breakdown-related trouble, a result of diagnosis relating to a cause of such a trouble based on the frequency of occurrence of such a trouble, and designation such as a procedure of checking the trouble, and a procedure of recovery.

The updating information may include information relating to upgrading and updating of the software application loaded on electronic component controlling devices, operating apparatus, and their parts. The updating information may include information concerning contents, price, delivery date, purchasing method, and loading method of such an upgraded/updated product.

A database section for storing apparatus information with respect to each apparatus may be configured integrally with a database section for storing specifications information with respect to each loom in a hardware manner. Alternatively, a database section for storing apparatus information and a database section for storing specifications information may be independently configured.

A novel loom user supporting system is provided with the above-mentioned host computer. The host computer is provided in a service center or a location of a user who uses the plurality of looms. A user computer is provided in a weaving factory or a location of the user who uses the plurality of looms. The user computer is connectable to the host computer via a communications way.

The user computer may be an administrative computer installed in the weaving factory or a data transmission unit provided in each loom in the weaving factory. The administrative computer can perform another administrations of the factory in addition to the sending of query information. The data transmission unit is adapted for performing data transmission of the loom.

The host computer is operative to provide appropriate advice information which is practically feasible with respect to a specific loom on service in a weaving factory where the specific user computer is installed in response to query information from the specific user computer among a plurality of user computers which accesses the host computer via the communications way. It should be appreciated that the service center may be a service section of a loom manufacturer, or a service station such as loom sales dealer or agency covering a region where the weaving factory resides. Further, it should be appreciated that the user computer is operative to access the host computer by attaching the loom identifying information to the query information to make it possible for the host computer to identify the requested loom in the weaving factory where the user computer is installed.

In the case where the user computer is an administrative computer installed in the weaving factory, the user can access the host computer by operating the administrative computer. The administrative computer may be a computer connected on-line to each loom for monitoring the operating efficiency thereof, or a stand-alone type computer which is independently operated of the looms.

In the case where the user computer is a data transmission unit provided in each loom, the user can access the host computer directly from each loom via the corresponding data transmission unit. In this case, it is preferable to configure the data transmission unit connectable to the communications way and to, according to needs, allow the data transmission unit to automatically output the loom identifying information for identifying the loom in which the data transmission unit is provided. Alternatively, the data transmission unit may have a function of automatically setting conditions with respect to each apparatus. In the latter case, the host computer can automatically set optimal operating conditions with respect to each apparatus based on advice information from the host computer via the data transmission unit connected to the communications way.

The communications way may include generally available wired phone communications channels, mobile phone communications channels, dedicated communications channels, and the Internet.

This application is based on patent application No. 2001-294732 filed in Japan, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A host computer for supporting a plurality of loom users comprising:

a database section which stores specification information relating to specifications of each of the plurality of looms, the specification information including apparatus information relating to an operating apparatus provided in each loom; and an advice information providing section which receives query information including loom identifying information sent via a communications way from an inquiring user of one of a plurality of users, and identifies the inquiring user and an identified loom with respect to which the inquiring user requires advice information based on the received query information, and extracts specification information relating to the identified loom from the database section and creates advice information with respect to the identified loom based on the specification information and then provides the advice information to the inquiring user.

2. The host computer according to claim 1, wherein the advice information includes a judgment as to whether weaving according to requested weaving specifications is executable by the identified loom in response to the query information.

3. The host computer according to claim 2, wherein the database section stores apparatus identifying information with respect to the operating apparatus to identify the operating apparatus.

4. The host computer according to claim 3, wherein the database section stores at least one of maintenance information, compatibility information, troubleshooting information, and updating information with respect to the operating apparatus.

5. The host computer according to claim 1, wherein the database section stores apparatus identifying information with respect to the operating apparatus to identify the operating apparatus.

6. A loom user supporting system comprising:

a host computer including:

a database section which stores specification information relating to specifications of each of a plurality of looms, the specification information having apparatus information relating to an operating apparatus provided in each loom; and an advice information providing section which receives query information including loom identifying information sent via a communications way from an inquiring user computer of one of a plurality of users, and identifies the inquiring user and an identified loom with respect to which the inquiring user requires advice information based on the received query information, and extracts specification information relating to the identified loom from the database section, and creates advice information with respect to the identified loom based on the specification information and then provides the advice information to the inquiring user;

a user computer which is placed in a weaving factory of each user and is connectable to the host computer via the communications way to send query information.

7. The loom user supporting system according to claim 6, wherein the advice information includes a judgment as to whether weaving according to requested weaving specifications is executable by the identified loom in response to the query information.

8. The loom user supporting system according to claim 7, wherein the database section stores apparatus identifying information with respect to the operating apparatus to identify the operating apparatus.

9. The loom user supporting system according to claim 8, wherein the database section stores at least one of maintenance information, compatibility information, troubleshooting information, and updating information with respect to the operating apparatus.

10. The loom user supporting system according to claim 6, wherein the database section stores apparatus identifying information with respect to the operating apparatus to identify the operating apparatus.

11. The loom user supporting system according to claim 6, wherein the user computer is provided in a location of the user who uses the plurality of looms, while the host computer is provided in a location of a loom producer.

12. The loom user supporting system according to claim 6, wherein the user computer is used for another administrative purpose besides the sending of the query information.

13. The loom user supporting system according to claim 6, wherein the user computer is provided on each loom to perform data transmission to the loom.

14. A method for supporting a user using a plurality of looms, comprising the steps of:

storing specification information relating to specifications of each of a plurality of looms in a database section, the specification information including apparatus information relating to an operating apparatus provided in each loom;

receiving query information including loom identifying information sent via a communications way from a user computer of one of a plurality of users;

identifying the inquiring user and an identified loom with respect to which the inquiring user requires advice information based on the query information;

extracting specification information relating to the identified loom from the database section;

creating advice information with respect to the identified loom based on the specification information obtained in said step of extracting; and providing the advice information to the inquiring user.

15. The method according to claim 14, wherein said step of creating the advice information further includes a step of determining whether weaving according to requested weaving specifications is executable by the identified loom in response to the query information.

16. The method according to claim 15, further comprising a step of identifying the operating apparatus using apparatus identifying information.

17. The method according to claim 16, wherein said step of identifying the operating apparatus using apparatus identifying information includes using at least one of maintenance information, compatibility information, troubleshooting information, and updating information with respect to the operating apparatus.

18. The method according to claim 14, further comprising a step of identifying the operating apparatus using apparatus identifying information.

19. A loom user supporting system comprising:

a host computer for use in a supporting system for supporting a user of a plurality of looms having:

a database section which stores specification information relating to specifications of each of the plurality of looms, the specification information including apparatus information relating to an operating apparatus provided in each loom; and an advice information providing section which receives query information including loom identifying information sent via the internet from an inquiring user of one of a plurality of users, and identifies the inquiring user and an identified loom with respect to which the inquiring user requires advice information based on the received query information, and extracts specification information relating to the identified loom from the database section and creates advice information with respect to the identified loom based on the specification information and then provides the advice information to the inquiring user; and a user computer connected via the internet to said host computer, and said user computer being connected to a plurality of looms installed in a user's factory.

20. A loom user supporting system comprising:

a host computer including:

a database section which stores specification information relating to specifications of each of a plurality of looms, the specification information having apparatus information relating to an operating apparatus provided in each loom;

an advice information providing section which receives query information including loom identifying information sent from an inquiring user computer of one of a plurality of users via the internet, and identifies the inquiring user and an identified loom with respect to which the inquiring user requires advice information based on the received query information, and extracts specification information relating to the identified loom from the database section, and creates advice information with respect to the identified loom based on the specification information and then provides the advice information to the inquiring user;

a user computer which is placed in a weaving factory of each user and is connectable to the host computer via the internet to send query information; and a plurality of loom computers connected to said user computer, each of said plurality of loom computers controlling a loom connected thereto.

* * * * *